United States Patent [19]

Leirnes et al.

[11] Patent Number: 4,508,565

[45] Date of Patent: Apr. 2, 1985

[54] METHOD FOR PRODUCING LEAD FROM OXIDIC LEAD RAW MATERIALS WHICH CONTAIN SULPHUR

[75] Inventors: Johan S. Leirnes, Skelleftehamn; Malkolm S. Lundström, Skelleftea; Martin L. Hedlund, Ursviken; Kurt J. A. Burén, Skelleftehamn, all of Sweden

[73] Assignee: Boliden Aktiebolag, Stockholm, Sweden

[21] Appl. No.: 605,660

[22] Filed: Apr. 30, 1984

[30] Foreign Application Priority Data

May 2, 1983 [SE] Sweden ..... 8302486

[51] Int. Cl.[3] ..... C22B 13/00

[52] U.S. Cl. ..... 75/77

[58] Field of Search ..... 75/77

[56] References Cited

U.S. PATENT DOCUMENTS 4,017,308 4/1977 Peterson et al. .

4,397,688 8/1983 Schwartz et al. ..... 75/77

FOREIGN PATENT DOCUMENTS 0007890 6/1980 European Pat. Off. .

0006832 9/1980 European Pat. Off. .

*Primary Examiner*—M. J. Andrews

*Attorney, Agent, or Firm*—Burns, Doane, Swecker & Mathis

[57] ABSTRACT

The invention relates to a method for producing lead having a sulphur content beneath about 2%, from sulphur-containing oxidic lead raw materials contaminated with zinc and/or other readily oxidized elements, by smelting the materials in a furnace in which the furnace contents can be agitated. When practicing the method, the lead raw materials are charged to the furnace together with iron-containing fluxes and solid reduction agents. The charged materials are heated under agitation, to form a lead phase and a slag phase. The amount of reduction agent charged is selected so that at least all the lead contained in the furnace is reduced to lead metal and the amount and composition of the fluxes are selected so that a terminal slag is obtained in which the sum of the iron and zinc present is 30–40%, and so that the slag has a content of 15–25% of both $SiO_2$ and $CaO+MgO$.

Lead raw materials, fluxes and reduction agents are suitably introduced in a plurality of charges, with intermediate moderate heating, prior to commencing the smelting process.

12 Claims, 1 Drawing Figure

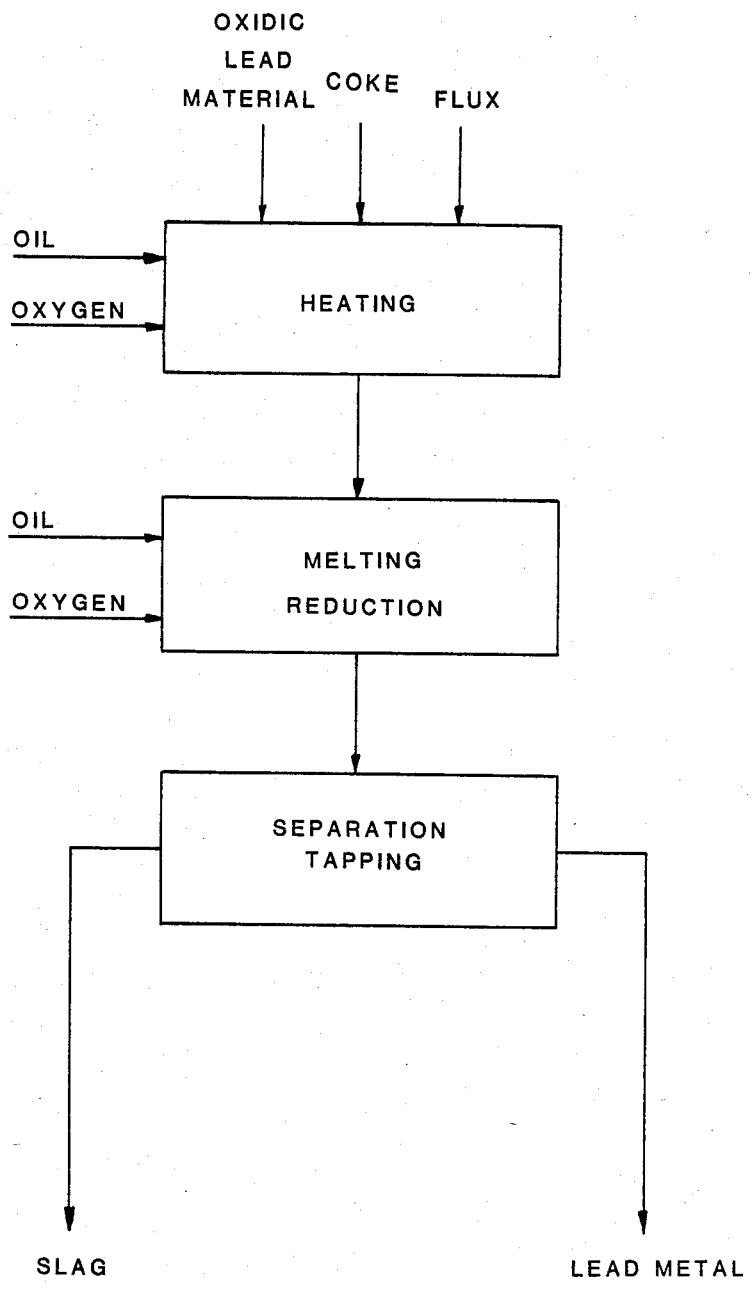
OXIDIC
LEAD
MATERIAL
COKE
FLUX
OIL
OXYGEN
HEATING
OIL
OXYGEN
MELTING
REDUCTION
SEPARATION
TAPPING
SLAG
LEAD METAL

METHOD FOR PRODUCING LEAD FROM OXIDIC LEAD RAW MATERIALS WHICH CONTAIN SULPHUR

The present invention relates to a method for manufacturing lead having a sulphur content of less than about 2%, from sulphur-containing oxidic lead raw materials contaminated with zinc and/or other readily oxidizable elements, by smelting said raw materials in a furnace in which the contents thereof can be agitated. In particular, the invention relates to working-up lead-containing intermediate products, such as various dusts, ashes and slags obtained in the metallurgical treatment of polymetallic raw materials, such as complex sulphide concentrates.

Lead is normally produced from sulphidic lead raw materials, such as concentrates. Lead, however, can also be produced from such metallic, oxidic and sulphatic lead raw materials as those designated lead-containing intermediate products. This type of intermediate product mainly comprises dust products obtained in different kinds of dust filters, for example dust filter bags, Cottrell precipitators, etc. These intermediate products are normally highly complex, and usually mainly comprise oxides and/or sulphates of Pb, Cu, Ni, Bi, Cd, Sn, As, Zn and Sb. The dusts may also sometimes contain valuable quantities of precious metals. Halogens, such as chlorine and fluorine, are normally also present. The composition of the dust varies widely, and consequently it is not possible to recite the composition of a typical material, although the lead content of the material should be in excess of 20%, of lead is to be produced economically from said material. As will be understood, the least amount of lead which the dust must contain in order to make the process economically viable will naturally depend upon the value of ther metals present, primarily tin and precious metals. Intermediate products of the aforementioned kind are obtained in large quantities in non-ferrous metallurgical processes, and naturally represent significant metal values.

Our earlier Swedish Patent Specifications Nos. 7317217-3 and 7317218-1 describe methods for manufacturing lead and refining lead respectively, from materials of the aforementioned kind, while using a top-blown rotary converter, for example of the Kaldo-type, as smelting and refining units. In addition hereto, our earlier Patent Specifications SE-B-7807357-4 and 7807358-2 describe methods for manufacturing and refining lead from, inter alia, the same type of lead-containing intermediate products, particularly those containing large quantities of copper and/or arsenic. A common feature of all these previously known methods is that the lead is produced in a two-stage method, in which the lead raw materials, together with fluxes, are smelted with the aid of an oxygen-fuel flame passed over the surface of the material in the furnace, to form a sulphur-lean lead and a slag which is rich in lead oxide, said slag having a PbO-content of 20–50%, normally 35–50%. The smelt is then subjected to a reduction stage, in which coke or some other suitable reduction agent is added to the smelt, while heat is supplied to the smelt and the converter rotated at a speed such as to create strong turbulence in the melt. A full smelting cycle, including the time taken to charge the furnace and to tap-off the melt, is approximately 5.5 hours in a normal operational plant.

The use of furnaces in which the melt can be vigorously agitated, for example by rotating the furnace, as described in our earlier Patent Specifications, results in a much higher smelting capacity and improved heat economy compared with the previously known, traditional methods for working-up oxidic lead raw materials, for example such methods as those carried out in shaft furnaces, flash furnaces or slowly rotating furnaces of the rotary furnace type, for example the so-called "Kurztrommelofen", normally used for working-up such lead raw materials. Despite the greatly improved process economy which can be achieved in this way, however, the operational costs and the capital involved are still so high as to render a transition from the old, tested processes less attractive in certain cases. The economy of the process is dependent upon the length of the smelting cycle for at least two essential reasons, namely because of its affect on the furnace capacity, or in other words the productivity, and partly because the amount of oil, or alternative fuel, required for heating while smelting and reducing the raw materials will naturally increase with increasing process times. Consequently, there is a great need for reduced process times, i.e. shorter smelting cycles, in order to further enhance the competitive ness of the method described in the introduction, vis-a-vis the traditional, older processes.

A further disadvantage associated with the known two-stage method is that the amount of lead oxide contained in the slag during the first stage of the process is so high as to damage the furnace lining, causing serious damage to the brickwork, which also contributes to higher operational costs.

It has now surprisingly been found that the time taken to carry out a smelting cycle in a method of the aforementioned kind can be greatly reduced, while simultaneously avoiding high lead-oxide contents in the slags formed, when, in accordance with the present invention, the smelting and reduction processes are carried out simultaneously, thereby converting the two-stage process to a single-stage process. In this respect, fluxes are also added, to form an accurately specified slag, containing approximately equal quantities of both $SiO_2$ and the sum CaO and MsO. The method is characterized by the process steps set forth in the following claims.

Thus, when the lead raw materials and fluxes are charged to the furance together with coke, or some other suitable solid reduction agent, there can be obtained a crude lead of low sulphur content while keeping the lead content of the slag low at the same time. One of the prerequisites for such simultaneous smelting and reduction of the charge, is that the furnace charge is agitated vigorously and uniformly during the whole of the smelting cycle. As beforementioned, it has also been found that the slag composition is critical. Consequently, the amount of flux charged to the furnace shall be adjusted so that the sum of the amount of zinc and the amount of iron present in the slag reaches from 30 to 40%, preferably about 35%, while each of the silica content and the sum of calcium oxide and magnesium oxide contents shall each be between 15 and 25%. The silica content shall preferably be about 20%, and the sum of the calcium oxide and magnesium oxide shall preferably be about 24% or immediately thereabove. By means of the method according to the invention, it is possible to reduce the length of a smelting cycle to between 55% and 65% of the time previously required, which also implies a reduction in the amount of oil required in the process, to form 30 to 50% of that required in the previous two-stage method.

The lead raw materials, flux and reduction agent can be mixed together, to form a single charge prior to being introduced into the furnace, although it is preferred to divide the mixed charge into a number of smaller charges, and to introduce each charge into the furnace separately while moderately heating the furnace contents between each charge, prior to commencing the smelting process. The flux used is preferably lime and an iron-silicate containing material, while coke is preferred as the reduction agent. The amount of reduction agent charged is such that at least all the non-metallic lead in the charge will be reduced to metal, although the amount of reductant can be increased when it is desired to reduce other, more difficultly reduced metals in the charge, for example tin, to the metal phase.

The content of the furnace can be agitated in a number of ways, for example pneumatically, mechanically or electroinductively. When the furnace unit used is a stationary reactor, for example a tiltable converter of the LD-type, the most suitable way of agitating the furnace contents is pneumatically, this being achieved by introducing a balanced stream of gas into the melt, through lances or in some other suitable manner. Another preferred alternative is one in which the melt is agitated mechanically, by rotating the furnace, there being used in this case a top-blown rotary converter, for example of the Kaldo-type. In this respect, suitable agitation is achieved when the furnace is rotated at a peripheral speed of about 0.3–3 m/s, suitably 1–2 m/s, measured at the inner surface of the furnace.

The heat required for smelting and reducing the charge is suitably provided with the aid of an oil-oxygen burner. The flow of oil during the smelting and reduction cycle is varied between about 0.3 and 1.0 l/min per ton of charge, the lower limits applying at the beginning of the cycle. The heating process is preferably effected with the aid of an oxidizing flame, whereupon the amount of oil consumed has been found to reach only about 70% of that required when heating with a neutral or weakly oxidizing flame. It is true that this may slightly increase the coke consumption, but the total energy costs are nevertheless much lower, since coke calories are less expensive than oil calories. Heating is effected in a manner to maintain a charge temperature of suitably 1100°–1150° C., preferably about 1125° C., during the smelting and reduction process.

The invention will now be described in more detail with reference to the accompanying drawing, the single FIGURE of which is a block schematic of a preferred embodiment of the invention, and also with reference to a working example of the preferred embodiment.

Oxidic lead raw materials, for example lead-dust pellets, are charged to the furnace together with flux, such as lime and granulated fayalite slag, and a solid reduction agent, such as coke. During the furnace-charging process, the furnace charge is heated with the aid of an oil-oxygen burner, while slowly agitating the charge. When the whole of the charge has been introduced into the furnace, agitation is increased by increasing the rotational speed of the furnace from about 0.5 m/s up to about 3 m/s, while maintaining said heating, so as to smelt and reduce the charge in the presence of the solid reduction agent, to form a sulphur-lean lead phase and a slag phase.

The method is continued for that length of time required to produce a lead containing less than 2% sulphur and a slag having a low lead content. Agitation of the charge is then stopped, so that lead and slag are able to separate from one another, whereafter the slag and lead are taken separately from the furnace.

EXAMPLE 12.5 tons of pellets formed from oxidic-sulphatic lead raw materials originating from copper-converter dust having the following basic analysis Pb 40%, Zn 12%, As 3.5%, Cu 1.15%, S 8.0%, Bi 0.5%, Sn 0.6%, were charged to a top-blown rotary converter of the Kaldo-type, having an inner diameter of 2.5 m, together with 1.0 tons of finely-divided limestone, 2.6 tons of granulated fayalite slag (iron-silicate-based slag obtained from copper manufacturing processes) and 0.7 tons of coke in particle sizes of between 5 and 12 mm.

The charge was heated with the aid of an oil-oxygen burner to a doughy consistency, which took 20 minutes from the time of commencing the charge. 300 liters of oil were consumed in the heating process. The converter was roated at 3 r.p.m. during the actual charging process, and immediately thereafter, whereafter the converter was rotated at 10 r.p.m. A further charge was then introduced into the converter, this charge comprising 12.5 tons of pellets, 1 ton of limestone, 2.6 tons of fayalite slag and 1.5 tons of coke. Heating was continued for 155 minutes at a converter rotation speed of 10 r.p.m. The converter was then tapped, and it was found that the raw lead had a sulphur content of 1.0% while the slag had a lead content of 1.4%. The temperature of the slag when tapping the converter was 1120° C. In other respects, the basic composition of the slag was Zn 16.5%, Fe 18%, As 1.4%, Sn 1.5%, $SiO_2$20%, CaO 21% and MgO1.5%. The complete smelting cycle, including charging and tapping the furnace, took 180 minutes to complete.

We claim:

1. A method for producing lead having a sulphur content of less than about 2% from a sulphur-containing lead raw material contaminated with at least one of zinc and other oxidizable elements by smelting the material in a furnace in which the contents thereof can be agitated, said method comprising:

(a) introducing the lead raw material into the furnace together with an iron-containing flux and a solid reducing agent, said reducing agent being in an amount at least sufficient to reduce the lead content of the furnace to lead metal;

(b) heating and agitating the contents of the furnace whereby the lead raw material is reduced to lead having a sulphur content of less than about 2% and whereby a low lead content slag is formed composed of iron and zinc in a total amount of from 30 to 40%, $SiO_2$ in an amount of from 15 to 25% and CaO and MgO in a total amount of from 15 to 25%; and (c) recovering the lead and the slag.

2. The method of claim 1 wherein the total amount of the lead raw material, the flux and the reducing agent is separated into a plurality of charges which are introduced into the furnace at intervals and wherein the contents of the furnace are subjected to moderate heating between the introduction of each of the charges.

3. The method of claim 1 or 2 wherein the flux is lime and an iron-silicate-containing material.

4. The method of claim 3 wherein the iron-silicate-containing material is granulated fayalite slag.

5. The method of claim 1 wherein the reducing agent is finely divided coke.

6. The method of claim 1 wherein the furnace is a top blown rotary converter wherein the agitating is caused by rotation of the converter.

7. The method of claim 6 wherein the converter has an inner surface and is rotated at a peripheral speed in the range of from 0.5 to 3 meters per second, as measured on the inner surface.

8. The method of claim 1 wherein the furnace is heated with an oil-oxygen burner.

9. The method of claim 8 wherein the furnace is heated with an oxidizing flame.

10. The method of claim 1 wherein the slag is composed of iron and zinc in a total amount of about 35%, $SiO_2$ in an amount of 20% and CaO and MgO in a total amount of about 24%.

11. The method of claim 1 wherein the contents of the furnace are maintained at a temperature of from 1100° to 1150° C.

12. The method of claim 1 wherein the contents of the furnace are maintained at a temperature of about 1125° C.

* * * * *